US008251369B2

(12) United States Patent
Verstraeten

(10) Patent No.: US 8,251,369 B2
(45) Date of Patent: Aug. 28, 2012

(54) GAME MACHINE

(75) Inventor: Eric Verstraeten, Sint-Niklaas (BE)

(73) Assignee: Elaut, N.V., Sint-Niklass (BE)

( * ) Notice: Subject to any disclaimer, the term of this patent is extended or adjusted under 35 U.S.C. 154(b) by 307 days.

(21) Appl. No.: 12/779,932

(22) Filed: May 13, 2010

(65) Prior Publication Data

US 2011/0180998 A1 Jul. 28, 2011

(30) Foreign Application Priority Data

Jan. 25, 2010 (BE) ..... 2010/0043

(51) Int. Cl.
*A63F 9/00* (2006.01)

(52) U.S. Cl. ..... 273/447; 273/448

(58) Field of Classification Search ..... 273/440, 273/447, 448, 456
See application file for complete search history.

(56) References Cited

U.S. PATENT DOCUMENTS

| | | | | |
|---|---|---|---|---|
| D96,564 | S | 8/1935 | Simpkins | |
| 5,397,134 | A | 3/1995 | Fishman et al. | |
| 5,549,372 | A | 8/1996 | Lewis | |
| 5,558,340 | A | 9/1996 | Ibe et al. | |
| 5,855,374 | A | 1/1999 | Shoemaker, Jr. | |
| D429,768 | S | 8/2000 | Smart | |
| D433,716 | S | 11/2000 | Robrahn et al. | |
| 6,461,239 | B1 | 10/2002 | Sagawa et al. | |
| D465,810 | S | 11/2002 | Bartholomew et al. | |
| 6,957,813 | B2 * | 10/2005 | Verstraeten | 273/448 |
| D596,677 | S | 7/2009 | Tsuda | |
| 7,604,238 | B2 * | 10/2009 | Verstraeten | 273/448 |
| D604,774 | S | 11/2009 | De Viveiros Ortiz | |
| D619,177 | S | 7/2010 | Lee | |

FOREIGN PATENT DOCUMENTS

| | | |
|---|---|---|
| BE | 1013738 | 7/2002 |
| BE | 1017038 | 12/2007 |

* cited by examiner

*Primary Examiner* — Nini Legesse
(74) *Attorney, Agent, or Firm* — Graham Curtin, PA

(57) ABSTRACT

Game machine comprising a housing with a number of upright walls, said housing being adapted to accommodate playing means, for instance pick-up means such as a grabber; wherein the upright walls of the housing comprise at least one translucent panel; and a pattern of multicolor LEDs is provided on the inner side of the housing behind this at least one translucent panel, said multicolor LEDs being connected to a control unit for controlling the color emitted by each multicolor LED, which control unit and at least one translucent panel are adapted to impart a determined impression of color to the at least one panel.

20 Claims, 9 Drawing Sheets

GAME MACHINE

CROSS REFERENCE TO RELATED APPLICATIONS

This application claims priority to Belgian Patent Application No. 2010/0043, which was filed on Jan. 25, 2010, the entire contents of which are incorporated herein by reference.

TECHNICAL FIELD

The present invention relates to a game machine comprising a housing adapted to accommodate playing means, in particular pick-up means for picking up one or more objects. The present invention also relates to an assembly of such game machines.

BACKGROUND OF THE INVENTION

Game machines with pick-up means are generally known and are for instance provided with a grabber or a vacuum head. Reference is made to the following applications in the name of the applicant: U.S. Pat. No. 6,957,813 and U.S. Pat. No. 7,604,238.

SUMMARY OF THE INVENTION

The present invention has for its object to provide a game machine, the appearance of which can be readily modified to the wishes of the user.

According to an embodiment of the invention, the game machine, comprises a housing with a number of upright walls, wherein the housing is adapted to accommodate playing means, in particular pick-up means such as a grabber for picking up one or more prizes. The upright walls of the housing comprise at least one translucent panel. A pattern of multicolor LEDs is provided inside the housing behind this at least one translucent panel. The multicolor LEDs are connected to a control unit for controlling the color emitted by each multicolor LED. The control unit and the at least one translucent panel are adapted to impart a determined impression of color to the at least one panel.

According to a preferred aspect of the invention, the pattern of multicolor LEDs is arranged such that a substantially uniform impression of color is imparted to said at least one translucent panel. Preferably, the multicolor LEDs are RGB LEDs capable of covering the full color spectrum. In that way, an upright wall of the housing can be given a particular color impression depending on the wishes of the user or the owner of the casino.

According to a preferred embodiment of the invention, the at least one translucent panel is manufactured from a material with a light transmission lying between 10% and 60%, preferably between 20% and 50%, and more preferably between 35% and 45%.The at least one translucent panel is preferably manufactured from a white translucent material having good light diffusion properties. Typically the material of the translucent panel has a light diffusion factor lying between 0.70 and 1.00.

According to a further aspect of the invention, the at least one translucent panel may comprises a translucent panel with a relief, wherein a pattern of multicolor LEDs is arranged in this relief. According to a possible embodiment, the pattern of multicolor LEDs is arranged along the edge of this relief, and such that the central emission direction of the LEDs is directed substantially toward the inner side of the relief.

According to a preferred embodiment, the pattern of multicolor LEDs is arranged such that the central emission direction of each LED thereof is substantially parallel to the translucent panel behind which said LED is provided. In that way light spots on the panel are avoided and a substantially uniform impression of color is imparted to the panel.

According to a preferred embodiment, the upright walls of the housing comprise a front wall and a first side wall adjacent the front wall. The front wall comprises at least one lower front panel and a transparent panel mounted above the translucent panel. In a similar way, the first side wall may comprise a translucent lower side panel and a transparent panel mounted above the translucent lower side panel.

According to a further possibility, an edge between the front wall and the first side wall may be provided with an elongate profile of a translucent material behind which a pattern of multicolor LEDs is arranged. The control unit and the translucent profile are then typically adapted to impart a determined impression of color to said profile.

According to another embodiment of the invention, the game machine comprises:

- a pick-up means, such as a grabber or a vacuum head, for picking up one or more objects, in particular one or more prizes to be won, in the housing;
- positioning means controllable by a user for placing the pick-up means over one or more objects;
- a central game controller for controlling drive means of the pick-up means;
- a housing having a number of upright walls comprising at least one translucent panel;
- a pattern of multicolour LEDs being provided inside the housing behind said at least one translucent panel, said multicolour LEDs being connected to a control unit for controlling the color emitted by each multicolour LED;
- wherein said central game controller is preferably coupled to the control unit.

According to a preferred aspect of the invention, weight determining means are provided for determining the weight of the pick-up means, in which one or more picked up objects may be present in the case of a successful pick-up attempt, or a variable related to said weight. The weight determining means are typically coupled to the central game controller.

According to yet another embodiment of the invention, the game machine comprises a housing with a number of upright walls and a bottom. The housing is adapted to accommodate playing means, for instance pick-up means such as a grabber. The bottom of the housing comprises a translucent panel, wherein a pattern of multicolor LEDs is provided on the inner side of the housing above said translucent panel. The multicolor LEDs are connected to a control unit for controlling the color emitted by each multicolor LED. The control unit and the translucent panel are preferably adapted to create a determined colored glow over the bottom of the housing.

According to another embodiment of the invention, the game machine comprises a housing with a number of upright walls and a translucent horizontal platform inside the housing, on which platform for instance prizes can be arranged. The housing typically comprises playing means such as pick-up means for picking up one or more prizes arranged on the translucent horizontal platform. A pattern of multicolor LEDs is provided inside the housing and is connected to a control unit for controlling the color emitted by each multicolor LED. Preferably the pattern of multicolour LEDs is provided under the translucent platform, wherein the control unit and the translucent platform are adapted to impart a determined impression of color to the platform.

According to another embodiment of the present invention, the game machine comprises a housing with a number of upright walls and a horizontal platform inside the housing. On the horizontal platform granules are arranged. The prizes can be arranged above the granules. A pattern of multicolor LEDs is provided inside the housing underneath this platform. The multicolor LEDs are connected to a control unit for controlling the color emitted by each multicolor LED. The control unit, the horizontal platform and the granules are adapted to impart a determined impression of color to the granules. According to a variant thereof, the pattern of multicolor LEDs can also be arranged above the horizontal platform. In that case, the multicolor LEDs are preferably positioned to emit light in the direction of the granules, such that colored glow is created through the granules.

According to another object of the invention, there is provided an assembly of at least two machines as disclosed above. The control unit of each game machine of the assembly is preferably adapted to be able to impart a determined impression of color at the same moment in time, to the panels of each game machine of the assembly. The impression of color can differ for one or more game machines of the at least two game machines.

According to a possible embodiment of the assembly of the invention, a synchronization unit is provided. The synchronization unit is coupled to each control unit for the purpose of synchronizing each control unit with that of an adjacent game machine.

BRIEF DESCRIPTION OF THE DRAWINGS

The above stated and other features of the invention will be further elucidated herein below on the basis of a number of exemplary embodiments, which will be described with reference to the appended drawings. In the drawings.

DETAILED DESCRIPTION OF THE PREFERRED EMBODIMENTS

Figure 1:
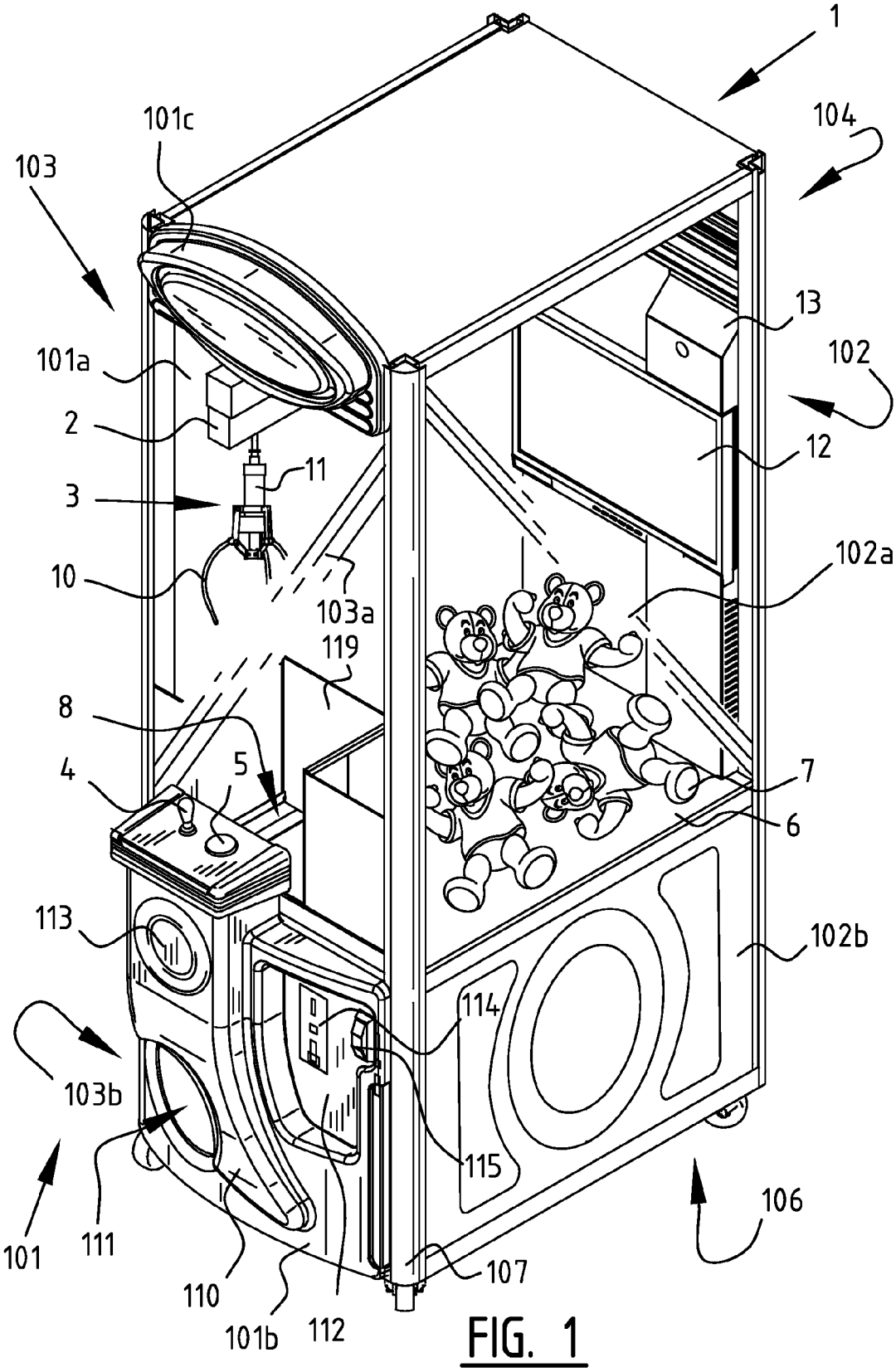
FIG. 1 is a perspective view of a first embodiment of a game machine according to the invention.

FIG. 1 shows a game machine essentially consisting of a cabinet 1 in which a number of prizes 7, which may or may not differ from each other, are present. These prizes 7 typically lie on a horizontal platform 6 at a certain height above the ground. A horizontally displaceable carriage 2 is provided in the upper part of cabinet 1, from which carriage a pick-up means, here a grabber 3, is suspended. Grabber 3 typically comprises three grabbing claws 10 and drive means 11 for opening and closing said grabbing claws, which drive means 11 can be controlled from a central control unit (not shown).

Cabinet 1 is further provided with operating means 4, 5, which are intended to be operated by a player. In the shown example the carriage can be displaced in a horizontal field using a joystick 4. The skilled person will appreciate that other means such as arrow keys are also suitable instead of a joystick. One or more additional buttons 5 may be further provided, for example a start button, a button by which a player can indicate that he or she wishes to make a grab attempt, and/or a button with which a second or further grab attempt can be made at the position where the grabber has come up empty or at the position where the object was lost. Once a user has grabbed a prize 7 with grabber 3, this prize is carried to prize compartment 8. Note that the size of prize compartment 8 can be adjustable by making wall 119 adjustable (see the arrow in FIG. 1).

Although a specific embodiment of a game machine with a grabber 3 is described here, the skilled person will appreciate that the measures of the invention are also applicable to any other game machine in which other game means are provided in a cabinet or housing, wherein it is for instance possible to envisage coin and token games and games of skill.

Cabinet 1 consists essentially of a front wall 101, two side walls 102, 103, a rear wall 104, an upper wall 105 and a bottom 106. Front wall 101 here consists essentially of an upper transparent panel 101*a*, a lower translucent panel 101*b* and an (optionally) translucent top panel 101*c*. Each side wall likewise comprises an upper transparent panel 102*a*, 103*a*. If the game machine has one or two free side walls, i.e. a side wall against which another device is placed, it may then be advantageous to also provide these one or two side walls at the bottom with a translucent panel 102*b*, 103*b*, whereby a determined color can also be given to lower side panel 102*b*, 103*b*, see further. Along the edge between the front wall and a side wall an elongate translucent profile can further be provided extending between the lower part and upper part of the cabinet. In the example shown in FIG. 1 such a profile 107 is provided along the whole upright edge between front wall 101 and side wall 102.

According to a variant (not shown) of the embodiment of FIG. 1, horizontal platform 6 could be embodied, instead of front panel 101*b*, as a translucent panel under which a pattern of multicolor LEDs is arranged. As a further variant, the bottom 106 could be translucent, wherein the pattern of LEDs is arranged above the bottom and causes as it were a colored glow under the game machine.

According to yet another variant (not shown) of the embodiment of FIG. 1, granules can be provided in cabinet 1 on horizontal platform 6. These are typically plastic granules (granulate) manufactured from a transparent or translucent material, and for instance from polycarbonate (PC). In such an embodiment the LED pattern could be provided on or under platform 6, wherein the light is emitted by diffusion through the granule layer, thus imparting a uniformly distributed impression of color to the granules. According to another option, an array of RGB LEDs can be provided on the inner side of the front wall just above platform 6, this such that the LEDs emit light in the direction of the granules arranged on platform 6. A light glow in a determined color is in this way obtained which moves from front to rear. It will be self-evident that these measures (translucent front panel 101*b*, translucent side panel, translucent bottom 106, translucent horizontal platform, granules etc.) can be combined at random in accordance with the intended effect.

The one or more lower translucent panels 101*b*, and optionally 101*c* and/or 102*b* and/or 103*b* and/or profile 107 and/or the bottom 106 and/or the platform 107 are preferably manufactured from a high-quality vandal-roof plastic, typically a material with a light transmission lying between 10% and 60%, preferably between 30% and 50%, and still more preferably between 35% and 45%. The translucent panel is typically manufactured from a translucent material, such as a translucent polycarbonate having good light diffusion properties. The material typically has a white color, and preferably has a light diffusion factor lying between 0.70 and 1.00 (DIN 5036 test method), and lying for instance between 0.75 and 0.90. Examples of suitable commercially available materials are Makrolon® GP or Lexan SG305-OB.

The one or more opaque panels can for instance be formed by a vacuum forming technique. The average thickness of the panel typically lies between 2 and 10 mm, and preferably between 3 and 7 mm. Note that the thickness can vary between the different zones of the panel as a consequence of the forming operation.

Provided on the inner side of housing 1, behind each translucent panel 101*b* (and optionally 102*b* and/or 103*b* and/or 101*c* and/or 106) is a pattern of multicolor LEDs, typically RGB LEDs with which the full color spectrum can be covered. These multicolor LEDs are connected to a control unit, not shown in FIG. 1, for controlling the color emitted by each of the multicolor LEDs. In other words, the control unit and translucent panels 101*b* (and optionally 102*b* and/or 103*b* and/or 101*c* and/or 106) are adapted to impart a determined impression of color to these panels. The color emitted by the different RGB LEDs of the same device will typically be the same, although the skilled person will appreciate that a different color could for instance also be given to different walls of a game machine, and that the color can vary and can for instance be a function of a game situation, such as a won game, a lost game and so on.

The lower translucent panel 101*b* of the front wall is a panel with a relief 110, the panel being further provided with a number of recesses 111, 112, 113. Recess 112 provides access to a coin slot 114 and a slot 115 typically coupled to a three-point locking, see further. Recess 111 provides access to prize compartment 8. Arranged in recess 113 is a loudspeaker on which for instance a logo can be provided in the middle. Relief 110 creates the space required for the purpose of concealing operating means 4, 5, the loudspeaker and other parts in the housing.

Figure 2A:
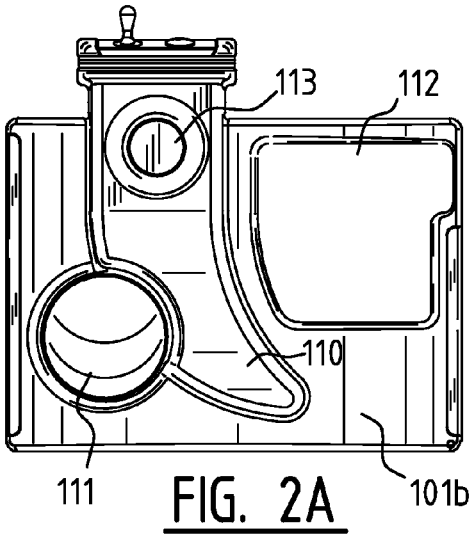
FIGS. 2A, 2B and 2C show schematic front views of respectively the front translucent panel of the game machine of FIG. 1 in the disassembled position, of a first embodiment of a support plate with LEDs against which this panel is mounted, and of a second embodiment of such a support plate with LEDs.
Figure 2B:
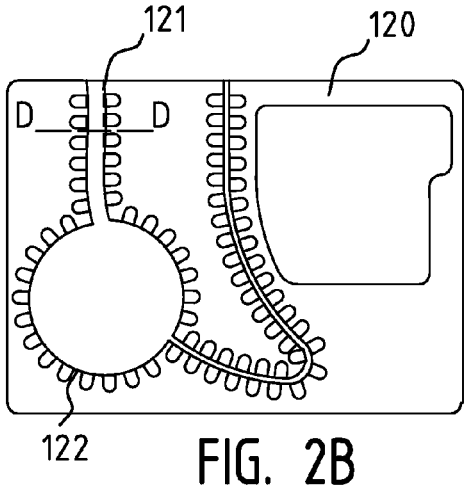
Figure 2D:
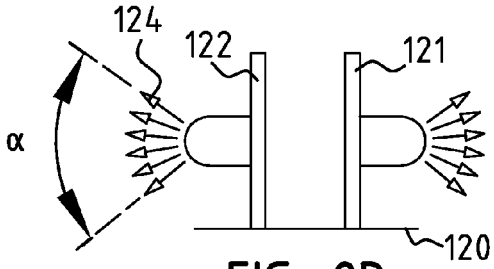
FIG. 2D is a cross-section through line D-D in FIG. 2B.
Figure 2C:
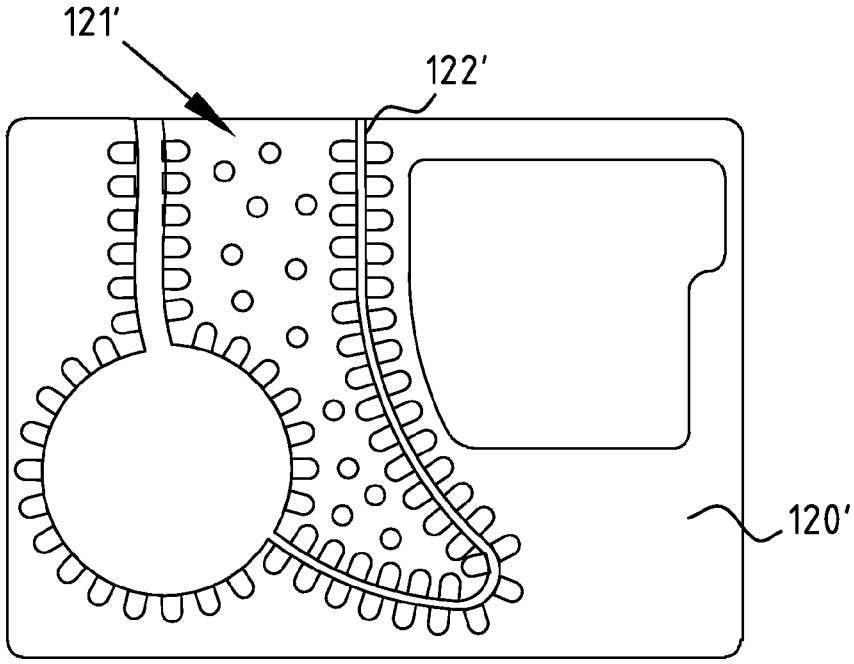

According to an exemplary embodiment, the pattern of multicolor LEDs for panel 101*b* is arranged on the inner side of the cabinet close to the periphery of this relief 110, close to opening 111 and at other locations. This is illustrated in FIGS. 2A and 2B. Panel 101*b* is arranged against a support plate 120 as shown in FIG. 2B. LED strips 121, 122 are arranged against support plate 120. As can be seen more clearly in the cross-section of FIG. 2D, the LED strips 121, 122 are mounted vertically on support plate 120 such that the central emission direction is substantially parallel to front panel 101*b*. The central emission direction 124 is understood to mean the direction passing through the middle of the emission angle a of a LED, see FIG. 2D. The first array of LEDs 121 are further directed toward the inner side of relief 110, while LEDs 122 are directed outward in order to illuminate particularly the rest of panel 101*b*. FIG. 2C illustrates an alternative embodiment of support plate 120' with a LED strip 122' similar to the LED strip 122, but with a LED surface 121' on which LEDs are arranged in distributed manner and have for instance a central emission direction substantially perpendicular to support plate 120'. The distance between the LEDs and the translucent panel, as seen along the central emission direction, is preferably at least 3 centimeters. This can be achieved in an advantageous manner for the LEDs of the LED surface 121' by providing a relief, such as for instance relief 110.

Figure 6:
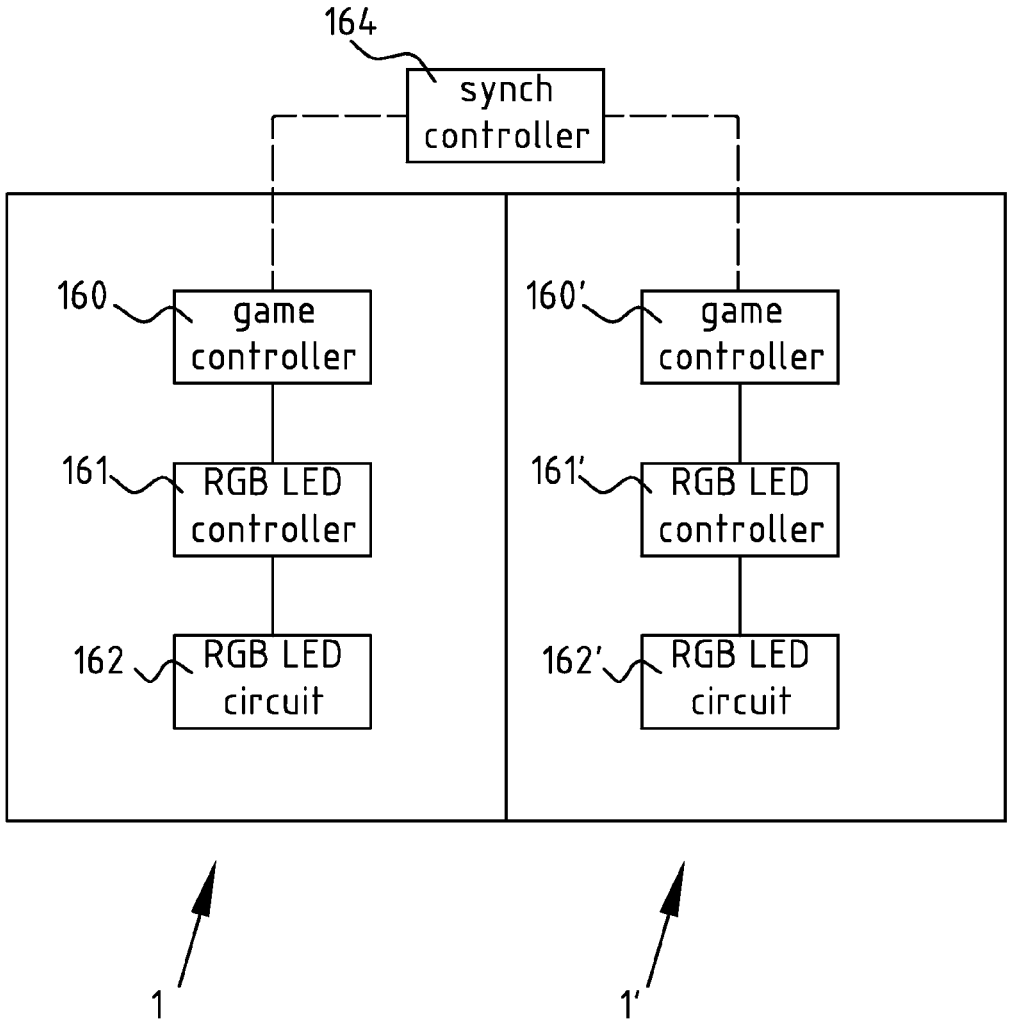
FIG. 6 is a schematic drawing of two adjacent game machines according to a preferred embodiment of the invention.
Figure 8:
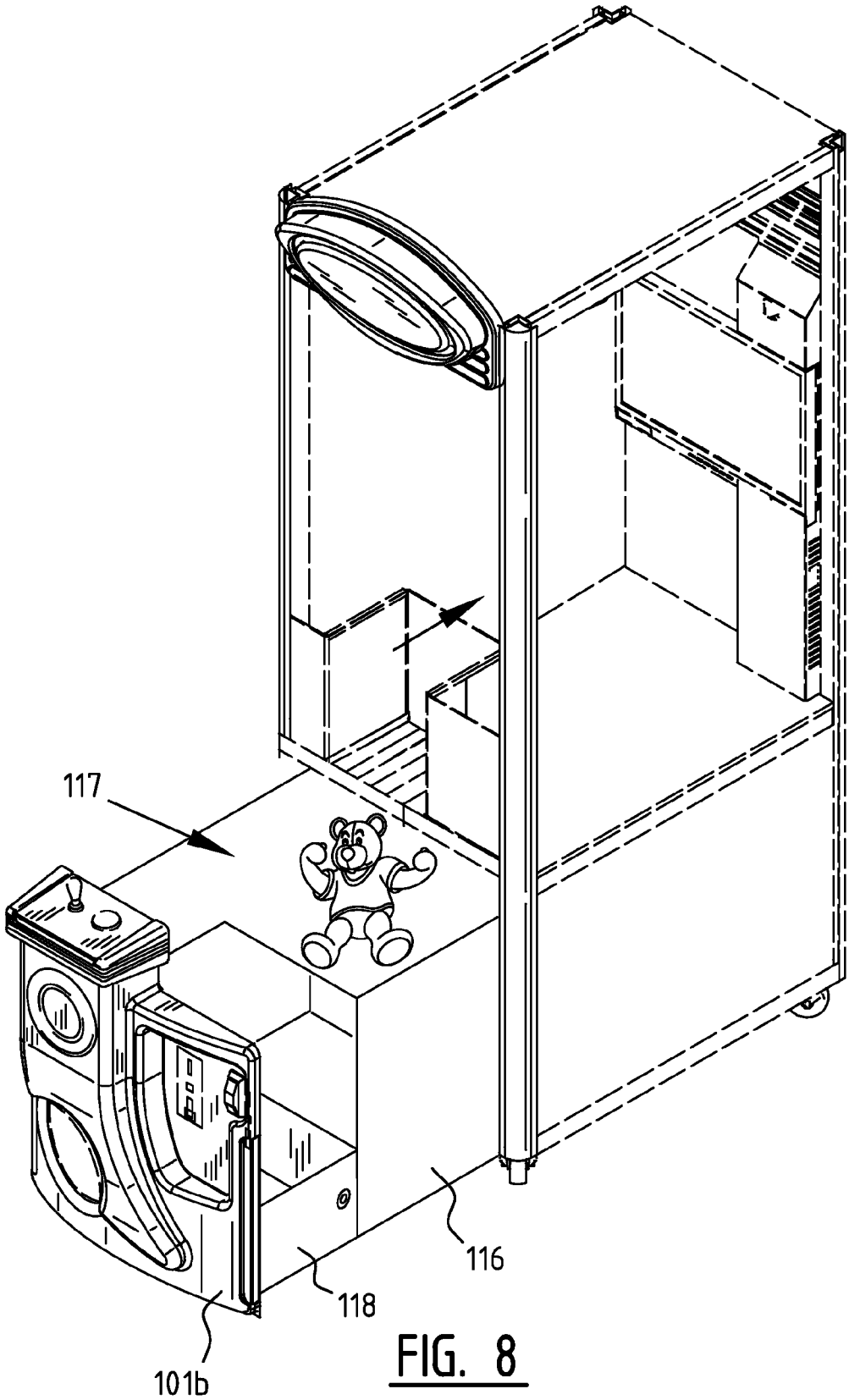
FIG. 8 is a schematic perspective view of an embodiment of a game machine largely similar to that of FIG. 1.
Figure 9:
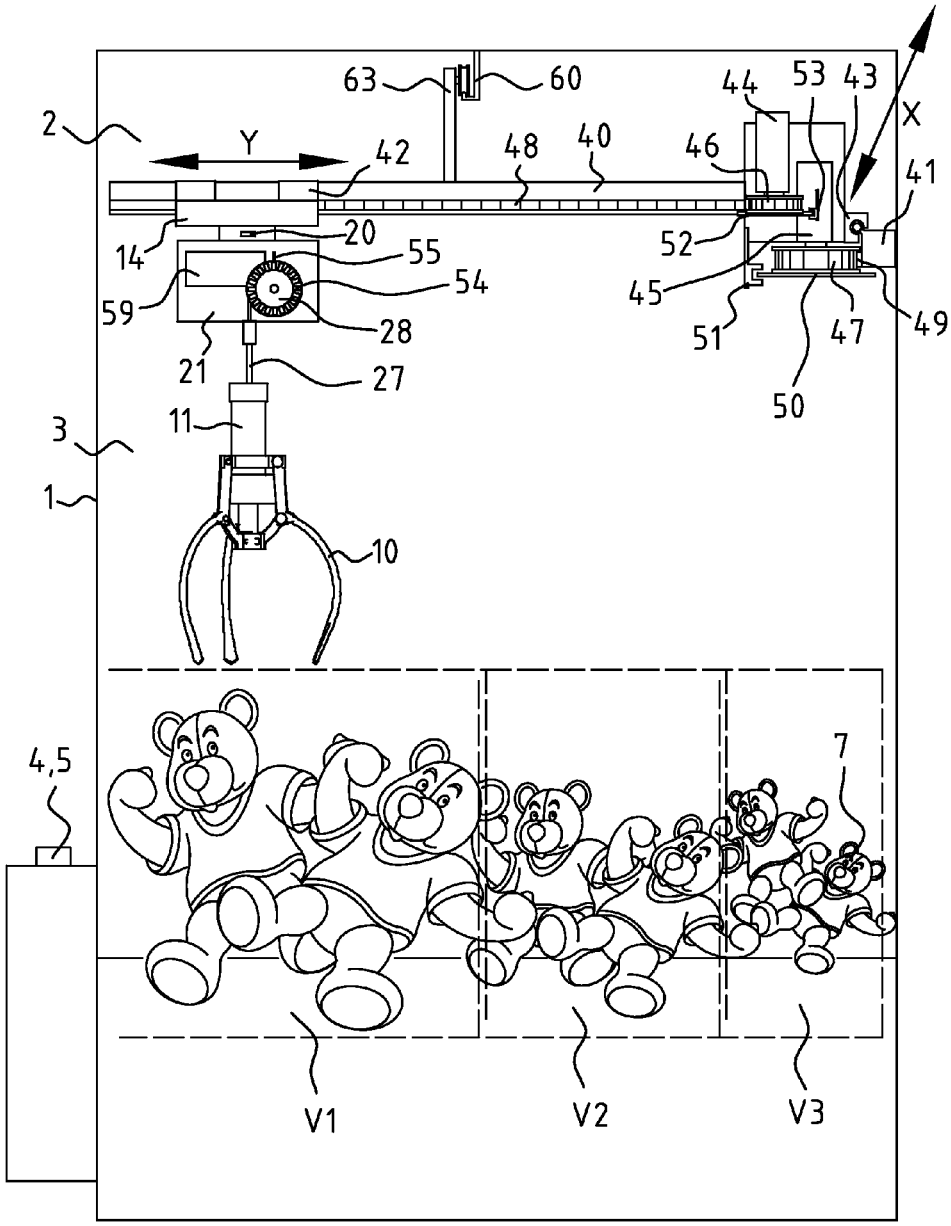
FIG. 9 is a side view of an embodiment of a grab crane with positioning means according to the invention.
Figure 10:
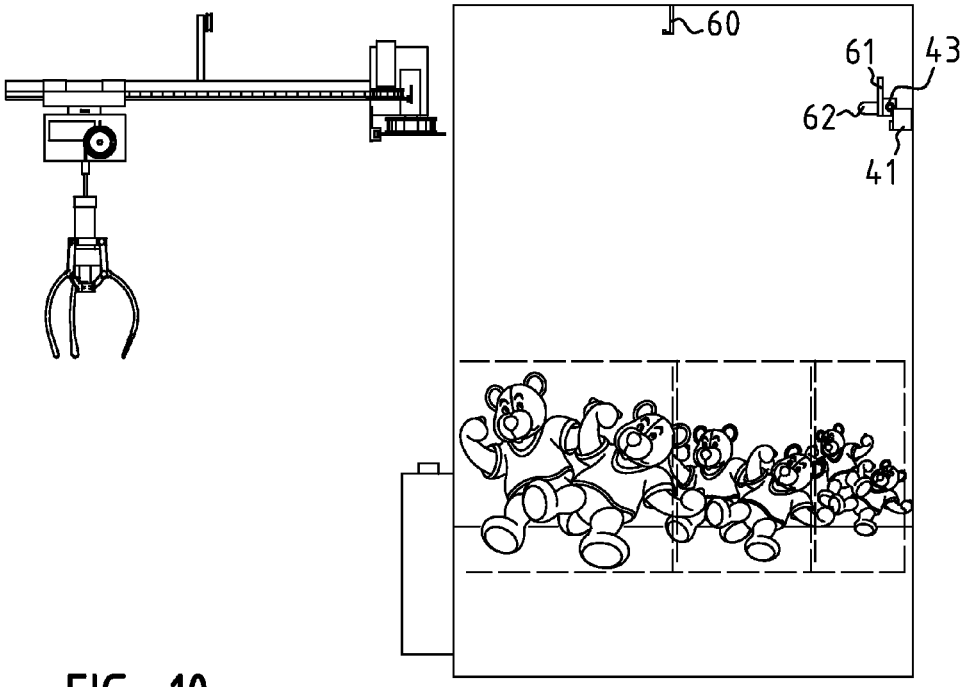
FIG. 10 is a view similar to the view of FIG. 9, but wherein a part of the grabber unit has been removed from the cabinet.
Figure 11:
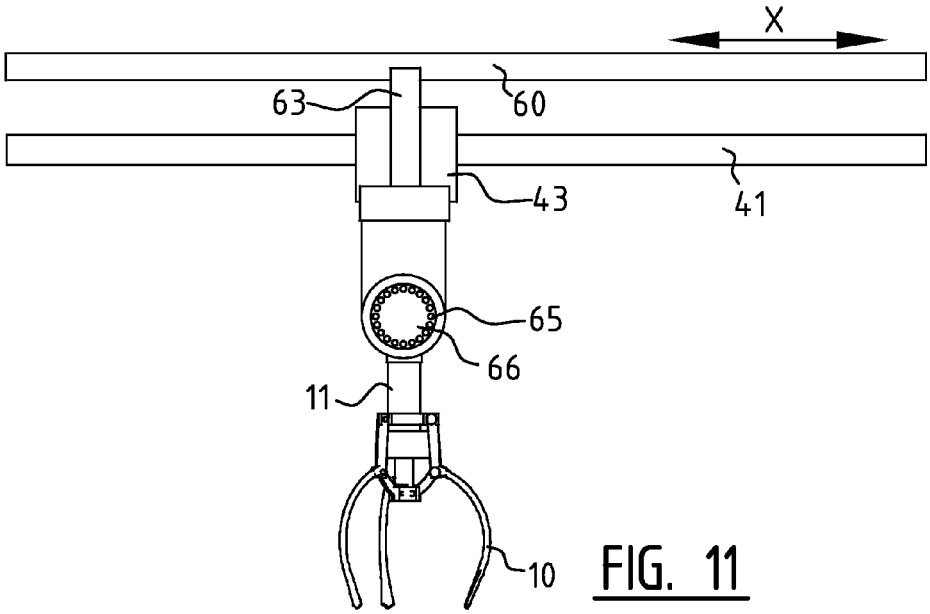
FIG. 11 is a schematic front view of another embodiment of a grab crane with a positioning system according to the invention.

Support plate 120 is mounted against drawer 116 which fits under platform 6 and is shown in FIG. 8. This drawer can be provided with an additional storage compartment 117, a closable cash box 118 and the electronics such as the central game controller 160, which will be further elucidated herein below with reference to FIG. 6. Note that support plate 120 is not shown in FIG. 8, since it lies behind front panel 101*b*.

Figure 3A:
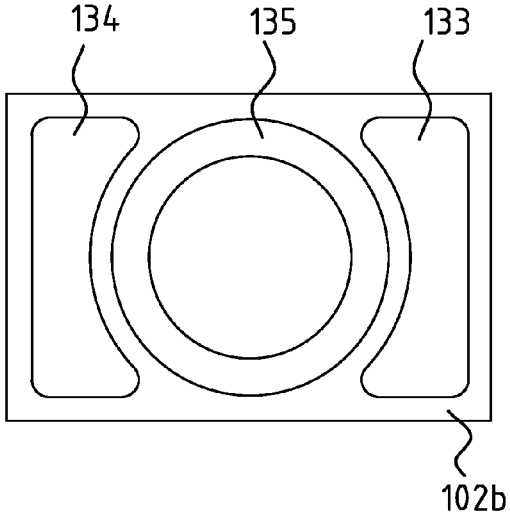
FIGS. 3A, 3B and 3C show schematic views of respectively an embodiment of the translucent panel for placing at the bottom of a side wall, of a first embodiment of a support plate with LEDs against which this panel is mounted and of a second embodiment of such a support plate.
Figure 3B:
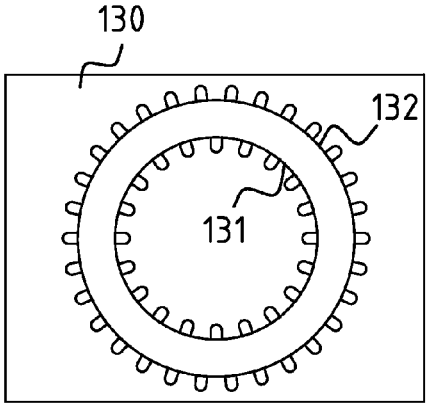
Figure 3C:
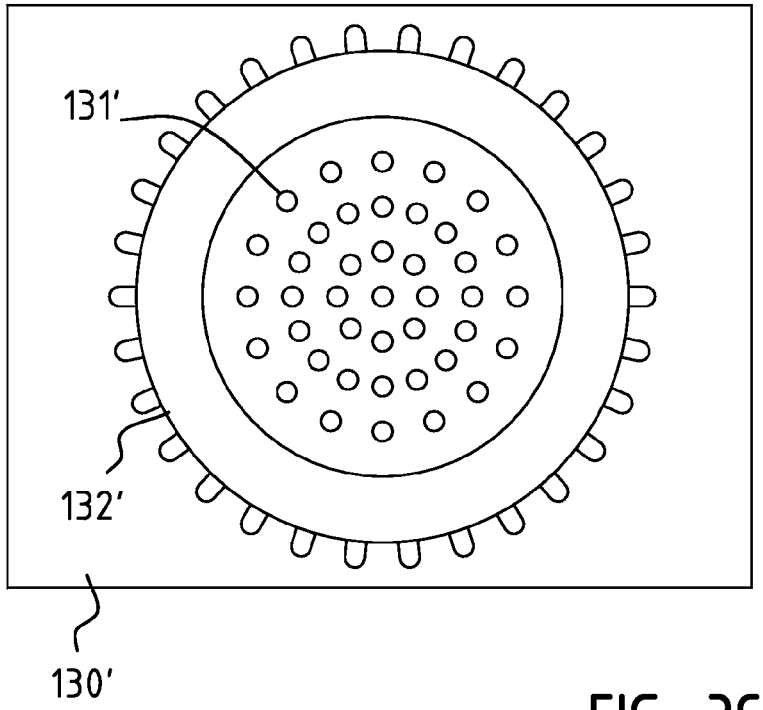

As illustrated schematically in FIGS. 3A and 3B, use can also be made for side wall 102 or 103 of a lower translucent panel 102*b* which is mounted against a support plate 130 on which a LED pattern 131 is arranged. This support plate 130 is attached to the frame of cabinet 1, and supports the translucent panel 102*b* which can also be provided with relief zones 133, 134, 135. In similar manner as for front panel 101*b*, two LED strips 131, 132 are provided with LEDs pointing respectively inward and outward. According to a variant, this can again also be implemented otherwise, and FIG. 3C illustrates an example in which LED strip 131 is replaced by a LED surface 131'.

The skilled person will appreciate that many other LED patterns can still be envisaged with which the desired effect, i.e. a more or less uniform illumination of the translucent panel, i.e. without individual light spots being visible, can be achieved.

Figure 4:
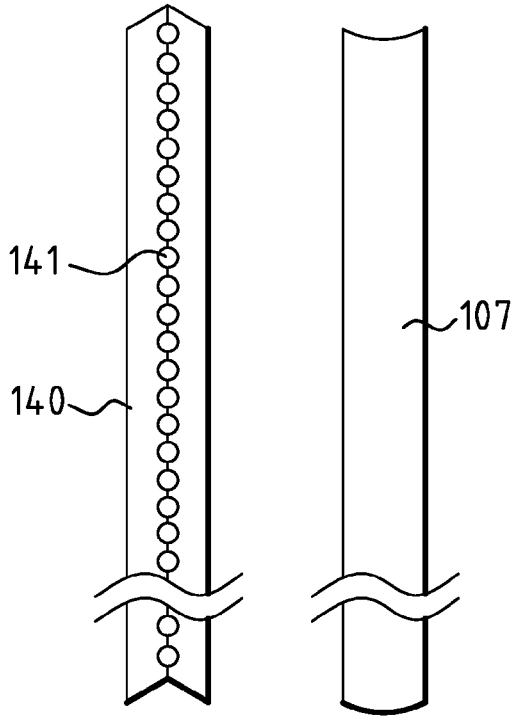
FIG. 4 is a schematic detail view in disassembled position of the edge between the front wall 101 and the side wall 102 of the game machine of FIG. 1.

An example of the above described elongate translucent profile 107 is illustrated in FIG. 4, together with a corner profile 140 against which this profile 107 is mounted. An optionally continuous RGB LED tubing/strip is typically provided against this corner profile 140 in order to impart a determined impression of color to translucent profile 107. Strip 141 is for instance arranged parallel to the front wall against corner profile 140. The control unit and translucent profile 107 are adapted in similar manner to impart a determined impression of color to this profile 107.

Figure 5A:
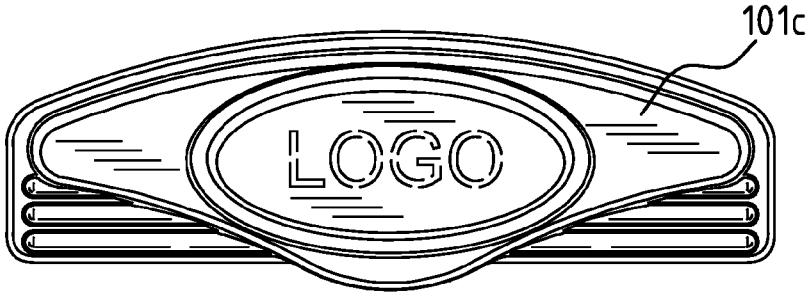
FIGS. 5A and 5B show schematic views of respectively the translucent top panel of the game machine of FIG. 1 in the disassembled position and of the support plate with LEDs against which this top panel is mounted.
Figure 5B:
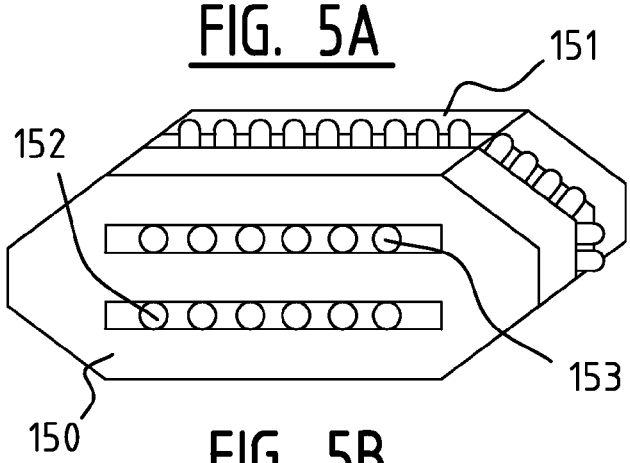

As discussed with reference to FIG. 1, front wall 101 can be provided at the top with an additional translucent top panel 101*c* behind which a pattern of RGB LEDs and/or white LEDs is also provided, see FIGS. 5A and 5B. Use is also made here of a support plate 150 with a pattern of LED tubing 151-153 coupled to the control unit. This support plate 150 is fixed against the frame of the cabinet and carries on its front side the top panel 101*c*, this such that the LED pattern can impart a determined impression of color to top panel 101*c*. Note that the LED strips 152, 153 typically comprise white LEDs and are intended to accentuate with white light the LOGO provided on panel 101*c*, see FIG. 5A. LED strip 151 typically comprises RGB LEDs and is intended to give the zone around the logo a determined color.

According to a further advantageous measure, a synchronization unit 160 is provided. This can be a separate unit provided outside game machine 1 or a unit built into one of the game machines of a set of adjoining game machines. This is shown schematically in FIG. 6, wherein two game machines are placed adjacently of each other. The central game controller 160 of each game machine 1, 1' is adapted for coupling to a synchronization unit 164 for synchronizing the different game machines 1, 1', and in particular control unit 161, 161' thereof, for the purpose of controlling the corresponding (RGB) LED circuits 162, 162'. Adjoining game machines can in this way change color at the same times, for instance in order to obtain a rainbow effect. Synchronization module 164 is typically an external component, but can also be accommodated in one of the game controllers 160, 160'. Game controller 160 can further be adapted to control, and particularly change, the light pattern in accordance with the stage of the game (for instance as a function of a win situation, a loss situation etc.). It is thus possible in a determined game situation to have for instance flashes of white light emitted by the LEDs.

Figure 7A:
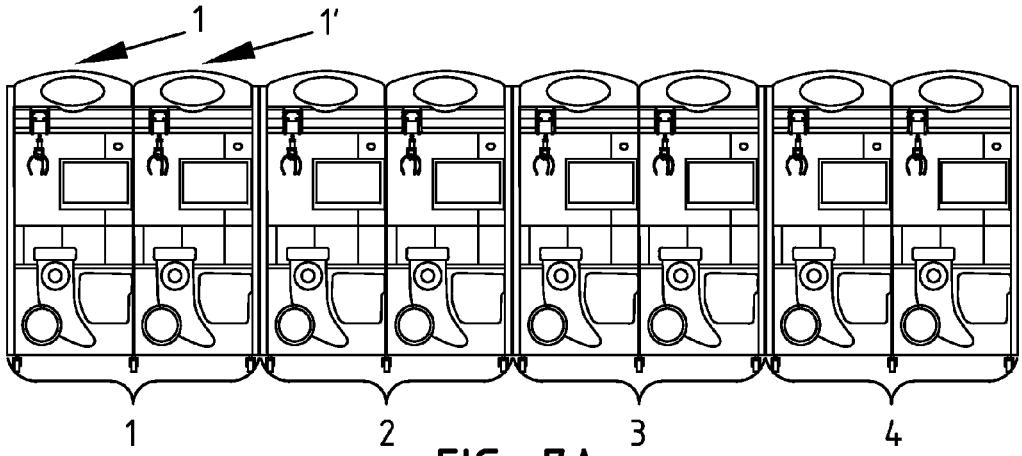
FIGS. 7A-C illustrate schematically an application of the invention.
Figure 7B:
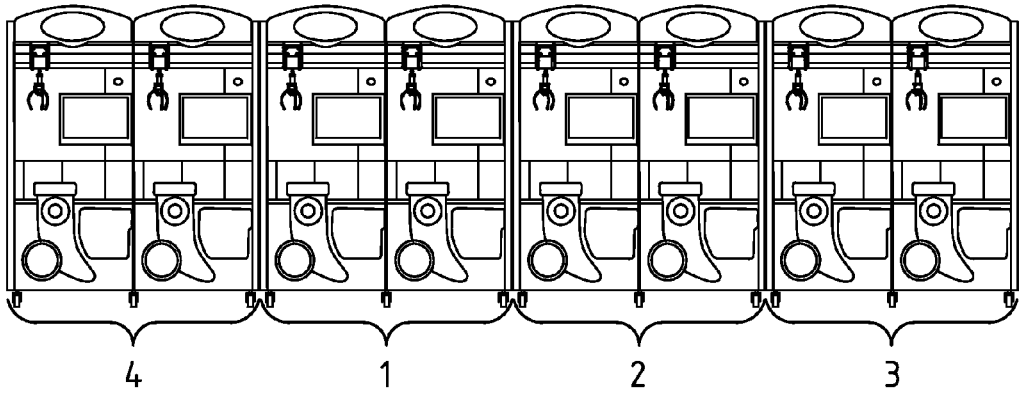
Figure 7C:
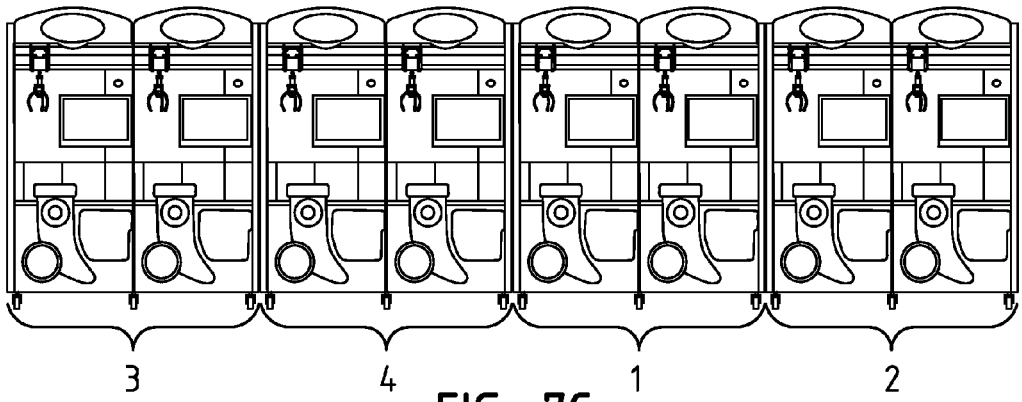

FIGS. 7A-C illustrate a number of adjoining game machines 1, 1' etc., to which a determined impression of color is imparted in pairwise manner. FIG. 7A illustrates a first color sequence C1, C2, C3, C4 at a first point in time t1 for the eight machines placed adjacently of each other. This sequence changes to a second color sequence C4, C1, C2, C3 at time t2. This can be performed in perfectly synchronous manner by synchronization unit 164 illustrated in FIG. 6.

The exemplary embodiment of the game machine of FIG. 1 is further provided with a screen 12, for instance a 22-inch LCD screen or similar, and a camera 13 placed against the inner side of rear wall 104. Although these measures of the invention are illustrated here specifically for a game machine with grabber, the skilled person will appreciate that these will also find application in other game machines. The control means of the game machine can for instance be adapted such that, when a player wins, he/she is photographed by camera 13. The photo of the player can for instance then be displayed, after he/she has given consent, in a so-called winners gallery displayed on screen 12. The most recent winner or a determined number of most recent winners can for instance be shown on the screen.

The carriage, the grabber and the system for moving and guiding the carriage can for instance be embodied as described in the patents BE 1013738 and BE 1017038 in the name of applicant, these patent specifications being included herein by reference. Weight determining means as described in the patent BE 1017038 can for instance be incorporated in carriage 2. The weight determined by the weight determining means is transmitted to the control unit. According to a possible embodiment, the gripping force can be controlled on the basis of the weight determined by the weight determining means. To this end the drive means 11 of the grabber claws may be provided with a control device controlled by the control unit. Sound animation means and/or display means may further be controlled from the control unit. Specific effects may then occur in the case of a loss or win which make the game even more attractive, see also the description above relating to the coupling between the central game controller 160 and LED controller 161. It is further possible to provide the user with extra credit in certain situations, for example when an object is lost, and/or to enable a new grabbing session, for example by illuminating a repeat grab button.

I claim:

1. Game machine, comprising a housing with a number of upright walls, said housing being adapted to accommodate playing means, in particular pick-up means for picking up one or more objects;

said upright walls of the housing comprising at least one translucent panel;

a pattern of multicolor LEDs being provided on the inner side of the housing behind said at least one translucent panel, said multicolor LEDs being connected to a control unit for controlling the color emitted by each multicolor LED, said control unit and said at least one translucent panel being adapted to impart a determined impression of color to the at least one panel.

2. Game machine as claimed in claim 1, wherein the pattern of multicolor LEDs is arranged such that a substantially uniform impression of color is imparted to said at least one translucent panel.

3. Game machine as claimed in claim 1, wherein the multicolor LEDs are RGB LEDs capable of covering the full color spectrum.

4. Game machine as claimed in claim 1, wherein the at least one translucent panel is manufactured from a material with a light transmission lying between 10% and 60%, preferably between 20% and 50%, and more preferably between 35% and 45%.

5. Game machine as claimed in claim 1, wherein the at least one translucent panel is manufactured from a white translucent material.

6. Game machine as claimed in claim 1, wherein the translucent panel is manufactured from a material having good light diffusion properties, preferably having a light diffusion factor lying between 0.70 and 1.00.

7. Game machine as claimed in claim 1, wherein the at least one translucent panel comprises a panel with a relief; a pattern of multicolor LEDs being arranged along the edge of this relief, said multicolor LEDs having a central emission direction directed substantially toward the inner side of the relief.

8. Game machine as claimed in claim 1, wherein the pattern of multicolor LEDs is arranged such that the central emission direction of each LED thereof is substantially parallel to the translucent panel behind which said LED is provided.

9. Game machine as claimed in claim 1, wherein the upright walls comprise a front wall, wherein said at least one translucent panel comprises a lower front panel; said front wall consisting substantially of said lower translucent front panel and a transparent panel mounted there above.

10. Game machine as claimed in claim 9, wherein the upright walls further comprise a first side wall adjacent the front wall; said at least one translucent panel comprising a lower side panel; said first side wall consisting substantially of said lower translucent side panel and a transparent panel mounted there above.

11. Game machine as claimed in claim 10, wherein an edge between the front wall and first side wall is provided with an elongate profile of a translucent material behind which a pattern of multicolor LEDs is arranged, wherein the control unit and said translucent profile are adapted to impart a determined impression of color to said profile.

12. Game machine as claimed in claim 1, wherein a synchronization unit coupled to the control unit is provided, said synchronization unit being adapted for coupling to a control unit of an adjacent game machine for the purpose of synchronization with an adjacent game machine.

13. Game machine of claim 1, further comprising:

a pick-up means for picking up one or more objects, in particular one or more prizes to be won, in the housing;

positioning means controllable by a user for placing the pick-up means over one or more objects;

a central game controller for controlling drive means of the pick-up means, which central game controller being coupled to the control unit.

14. Game machine as claimed in claim 13, wherein weight determining means are provided for determining the weight of the pick-up means including one or more picked up objects in the case of a successful pick-up attempt, or a variable related to said weight; said weight determining means being coupled to the central game controller.

15. Assembly of at least two game machines as claimed in claim 1, wherein the control unit of each game machine of the assembly is adapted to be able to impart a determined impression of color at the same moment to the panels of each game machine of the assembly, wherein the impression of color can differ for one or more game machines of the at least two game machines; a synchronization unit coupled to each control unit being provided for the purpose of synchronizing each control unit with that of an adjacent game machine.

16. Game machine, comprising a housing with a number of upright walls and a bottom, said housing being adapted to accommodate playing means, in particular pick-up means;

said bottom of the housing comprising a translucent panel;

a pattern of multicolor LEDs being provided on the inner side of the housing above said translucent panel, said multicolor LEDs being connected to a control unit for controlling the color emitted by each multicolor LED, said control unit and said translucent panel being adapted to create a determined colored glow under said bottom.

17. Game machine, comprising:

a housing with a number of upright walls, said housing being adapted to accommodate playing means, in particular pick-up means;

a translucent horizontal platform being provided in the housing;

a pattern of multicolor LEDs being provided inside the housing, said multicolor LEDs being connected to a control unit for controlling the color emitted by each multicolor LED, said control unit and said translucent platform being adapted to impart a determined impression of color to said platform.

18. Game machine as claimed in claim 17, wherein the pattern of multicolor LEDs is provided under the translucent platform.

19. Game machine as claimed in claim 18, wherein granules are arranged on the horizontal platform the control unit, said horizontal platform and said granules being adapted to impart a determined impression of color to the granules.

20. Game machine as claimed in claim 17, wherein granules are arranged on the horizontal platform; the pattern of multicolor LEDs being arranged to emit light in the direction of the granules; the control unit and said granules being adapted to create a colored glow through the granules.

* * * * *